US005829077A

United States Patent [19]

Neige

[11] Patent Number: 5,829,077

[45] Date of Patent: Nov. 3, 1998

[54] DEVICE FOR TILTING THE TOP END AND/ OR BOTTOM END OF A BED

[76] Inventor: Jean-François Neige, 13280 Raphéle-les Arles, Mas du Gondret, France

[21] Appl. No.: 817,593

[22] PCT Filed: Oct. 24, 1995

[86] PCT No.: PCT/FR95/01404

§ 371 Date: Apr. 23, 1997

§ 102(e) Date: Apr. 23, 1997

[87] PCT Pub. No.: WO96/12427

PCT Pub. Date: May 2, 1996

[30] Foreign Application Priority Data

Oct. 25, 1994 [FR] France ..... 94 12724

[51] Int. Cl.[6] ..... A47C 20/04; A47C 20/18

[52] U.S. Cl. ..... 5/618; 5/616; 5/617; 5/634

[58] Field of Search ..... 5/616, 617, 618, 5/620, 633, 634

[56] References Cited

U.S. PATENT DOCUMENTS

| | | | |
|---|---|---|---|
| 945,449 | 1/1910 | Edgecombe | 5/617 |
| 2,631,300 | 3/1953 | Murray | 5/618 X |
| 3,120,008 | 2/1964 | Watson | 5/634 |
| 3,191,196 | 6/1965 | Holm | 5/616 |
| 3,656,191 | 4/1972 | Kjellberg et al. | 5/616 X |
| 3,802,002 | 4/1974 | Jonas | 5/616 X |
| 3,931,653 | 1/1976 | Bien | 5/634 |
| 4,742,586 | 5/1988 | Galumbeck . | |
| 4,853,990 | 8/1989 | Elder et al. . | |
| 5,191,198 | 3/1993 | Travis | 5/618 |

FOREIGN PATENT DOCUMENTS

| | | | |
|---|---|---|---|
| 0 214 695 | 3/1987 | European Pat. Off. . | |
| 863378 | 3/1941 | France | 5/618 |
| 93 00 438.9 | 3/1993 | Germany . | |
| 263678 | 3/1929 | Italy | 5/634 |
| 642359 | 7/1962 | Italy | 5/618 |
| 651916 | 1/1963 | Italy | 5/660 |
| 383652 | 12/1932 | United Kingdom . | |
| 2215996 | 10/1989 | United Kingdom | 5/634 |
| WO 83/00805 | 3/1983 | WIPO . | |
| WO 92/09520 | 6/1992 | WIPO . | |

*Primary Examiner*—Kenneth J. Dorner
*Assistant Examiner*—Robert G. Santos
*Attorney, Agent, or Firm*—Young & Thompson

[57] ABSTRACT

A device for tilting the top end and/or bottom end of a bed, includes two hingedly connected frames and a control unit operably connected thereto for adjusting the spacing therebetween. One fixed frame is supported on the bed base while the other, movable frame supports one end of a mattress. The fixed frame comprises two parallel co-planar tubes and the movable frame consists of a U-shaped frame pivotably mounted on and between the tubes. The control unit is attached to the fixed frame and controls the longitudinal translation of slide blocks with worm screws. The blocks are slidable along the tubes to tilt the movable frame relative to the fixed frame. The worm screws are mounted in the two tubes and the control unit is located outside the area encompassed by the fixed frame.

13 Claims, 3 Drawing Sheets

DEVICE FOR TILTING THE TOP END AND/OR BOTTOM END OF A BED

The present invention concerns items of furniture such as beds or armchairs part of which can be tilted. It applies more particularly to beds the top end and/or bottom end of which can be raised or tilted.

BACKGROUND OF THE INVENTION

Such beds are well known, particularly in the medical field. Originally, the top and bottom ends of beds were raised manually. Currently, particularly in the field of domestic beds, the trend is to motorize controls for tilting the top end and/or bottom end of a bed.

It is in this context that special bed bases have been proposed, in particular with slats, comprising different hingedly connected parts and electric actuators to lift each of these parts.

However, such bed bases equipped with numerous hinges are difficult to make and therefore relatively expensive.

The primary objective of the present invention is to convert all types of bed into beds with top ends and/or bottom ends that can be raised or tilted.

A device has already been proposed, for example document WO-A-92 09520, for tilting the top end and/or bottom end of a bed comprising two hingedly connected support means or frames and a motorized control unit for adjusting the spacing there-between, said device being removably installable on a conventional bed, between the bed base and the mattress. Unfortunately, the control unit is located inside the perimeter defined by the frames so that it is not possible to achieve a horizontal position or, in this position, to benefit from the cooperation of the mattress with the bed base.

To overcome this disadvantage a device of the above kind has also been proposed according to U.S. Pat. No. 4,853,990 in which the control unit is not located within the perimeter defined by the frames: unfortunately, this is designed so that a completely horizontal position can also not be achieved in this case and the lifting angle is limited.

SUMMARY OF THE INVENTION

The object of the present invention is to propose a device for tilting the top end and/or bottom end of a bed that does not have the aforementioned disadvantages.

To achieve this, the invention proposes a device for tilting the top end and/or bottom end of a bed, including two hingedly connected support means or frames and a control unit operably connected thereto for adjusting the spacing there-between, said device being removably installable on a bed comprising a bed base and a mattress, wherein one, fixed frame is supported on said bed base while the other, movable frame supports one end of said mattress, said frames being disposed in an adjustable V-shaped opening, and wherein the fixed frame comprises two parallel coplanar tubes and the movable frame consists of a U-shaped frame pivotably mounted on and between said tubes, said control unit being attached to the fixed frame and controlling the longitudinal translation of slide blocks by means of worm screws, said blocks being slidable along said tubes, to tilt the movable frame relative to the fixed frame, characterized in that the worm screws associated with the slide blocks are mounted in said two tubes which extend longitudinally and the control unit is located outside the area encompassed by the fixed frame.

The use of this device therefore makes it possible to turn a conventional fixed bed into a bed with a top end and/or a bottom end that can be tilted under the control of a motor. The present invention, which does not require the use of hinged bed bases, solves the problems, in particular those of cost, of currently known beds with top ends and/or bottom ends that can be tilted.

In addition, because the device according to the present invention is removably installable, it can be used in alternation on several beds, or even other furniture such as reclining chair frames.

Advantageously, the fixed frame also consists of a U-shaped frame, said control unit being motorized and including a motor installed along the web of said U-shaped frame, outside the area encompassed by said U-shaped frame; preferably, the motor is mounted in a housing which extends along the base of said U-shaped frame outside the area encompassed by said U-shaped frame; the bottom side of the housing lies in the support plane of the fixed frame.

Advantageously, the shaft of the motor carries at its ends two pinions each engaged with a pinion at the end of the worm screw mounted in each tube.

Advantageously, the fixed frame also consists of a U-shaped frame, said control unit being motorized and including a motor, said motor being installed along one side of said U-shaped frame, outside the area encompassed by said U-shaped frame; preferably, the shaft of said motor carries at its end a pinion engaged with a pinion at the end of a shaft which has two pinions each engaged with a opinion at the end of the worm screw mounted in each tube.

Advantageously, the device also includes a second movable frame hingedly connected to the fixed frame and supporting the other end of said mattress, said control unit including an extension adapted to cooperate with slide blocks to adjust the angular position of said second movable frame; preferably, the device includes a means for deactivating the control acting on said second movable frame.

Advantageously, each slide block part of which passes through the tube by means of a slot in said tube is associated with a lever one end of which is pivotably mounted on said slide block the other end of which is mounted pivotably on one of the lateral sides of the associated movable frame.

Preferably, said tubes of the fixed frame extend beyond the pivoting points of the movable frame, their ends being connected by a flexible transverse band securing the device to the bed.

BRIEF DESCRIPTION OF THE DRAWINGS

Other features and advantages of the invention will emerge from the following description, with reference to the accompanying drawings in which.

DESCRIPTION OF THE PREFERRED EMBODIMENTS

Figure 1:
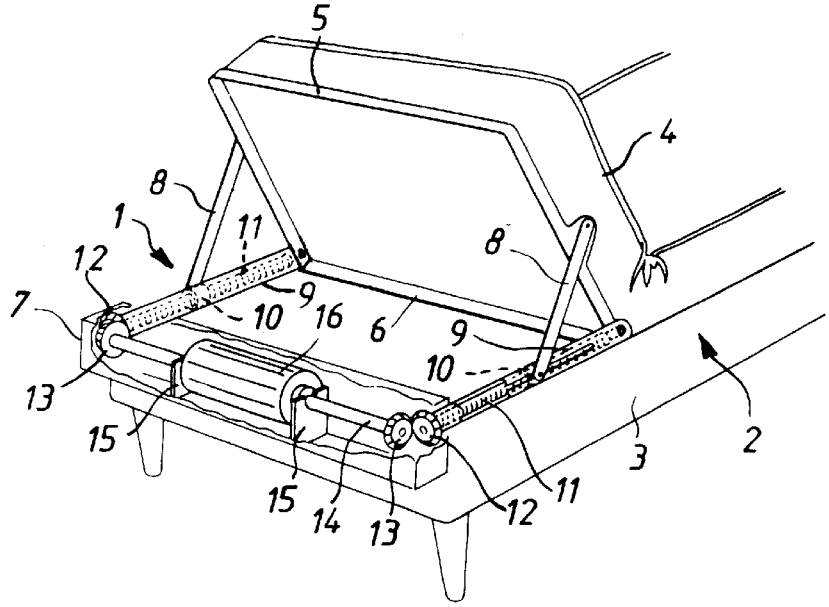
FIG. 1 is a diagrammatic perspective view showing a bed fitted with a device according to the present invention.

In the first embodiment shown in FIG. 1, a device 1 for tilting the head of a bed is installed on a bed 2 including a bed base 3 and a mattress 4. The bed base 3 is of any type whether sprung, slatted or even simpler still. FIG. 1 represents the head of the bed 2.

The device 1 includes two hingedly connected support means or frames.

The first of said support means, forming the base of the device, consists of a fixed frame formed from an extended parallelepiped-shape housing 7 and two lateral tubes 9 starting at either end of said housing from which they extend at right angles.

The two tubes 9 extend in the same support plane and are supported on the bed base 3 as shown in FIG. 1. The housing 7 extends along and outside the bed base to avoid interfering with the mattress when it is lying horizontally on said bed base. Advantageously, the bottom side of the housing 7 lies in the support plane of the two tubes 9. In this way, the device 1 can be used to raise and tilt a mattress laid directly on the ground.

The second support means of the device 1 comprises a movable frame in the form of a frame 5 pivotably mounted on one of its sides 6 between the free ends of the two tubes 9, as shown in FIG. 1. In this way, the fixed and movable frames of the device 1 extend along two support planes forming an adjustable width V. The inside of the frame 5 is free or consists of a lattice of metal wires (not shown) adapted to support the mattress.

As can be clearly seen in FIG. 1, this assembly forms a support plane adapted to keep one end of the mattress in a tilted position with respect to the rest of said mattress which extends horizontally.

Inside the housing 7 is installed a motor 16 secured by supporting flanges 15, said motor being substantially at the center of said housing, equidistant from the lateral tubes 9, with respect to which its shaft 14 extends at right angles. As shown in FIG. 1, the shaft 14 extends on either side of the motor, said shaft 14 carrying at its ends two pinions 13. Each of these pinions 13 is engaged with a pinion 12 at the end of a worm screw 11 mounted inside the lateral tube 9 on the corresponding side.

Inside each of the tubes 9 runs a movable slide block 10 the movement of which is controlled by the corresponding worm screw 11. The slide block 10, part of which passes through the tube 9 by means of a slot in it, is associated with a lever 8 one end of which is pivotably mounted on said slide block. The other end of the lever 8 is pivotably mounted on one of the lateral sides of the frame 5.

Thus, by means of two levers 8 operably connected to the lateral sides of the frame 5, the motor 16 is used to control the spacing between the two frames of the device 1 and consequently the tilt of the head of the mattress.

Figure 2:
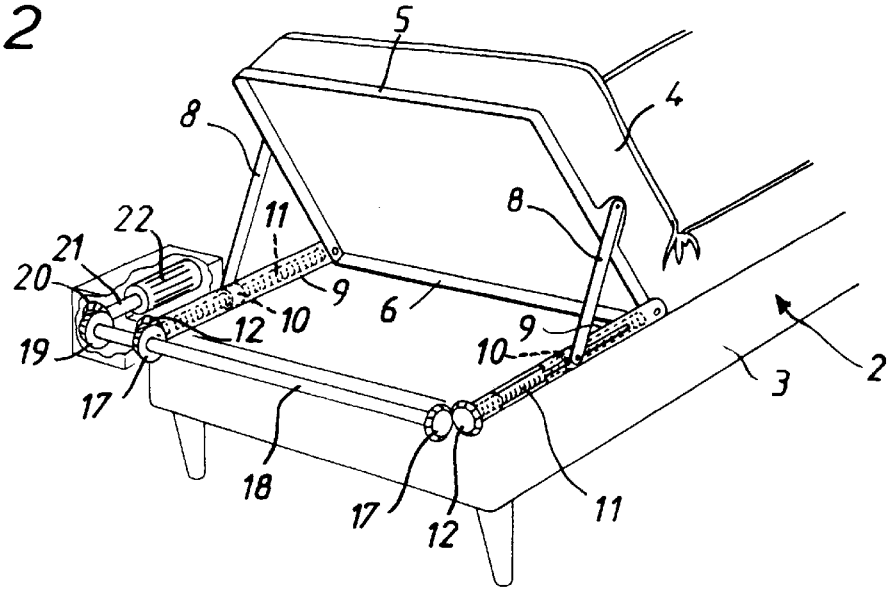
FIG. 2 is a diagrammatic perspective view showing a bed fitted with a device according to a variant of the present invention.

FIG. 2 shows an alternative embodiment according to which the device for tilting the head of a bed still comprises two frames one consisting of two lateral tubes 9 and the other of the frame 5. This time, however, the motor 22 controlling the spacing between the frames is no longer between the two tubes 9 but against one of these tubes, its shaft 21 extending parallel to the tubes as shown in FIG. 2.

This motor 22, located outside the bed base 3 along one of its lateral sides, includes at the end of its shaft 21 a pinion 20 engaged with a pinion 19 at the end of a shaft 18. The shaft 18 also has two pinions 17 corresponding to the pinions 13 of the previous embodiment. Power is transmitted between the pinions 17 and the levers 8 acting on the frame 5 as in the previously described example.

Figure 3:
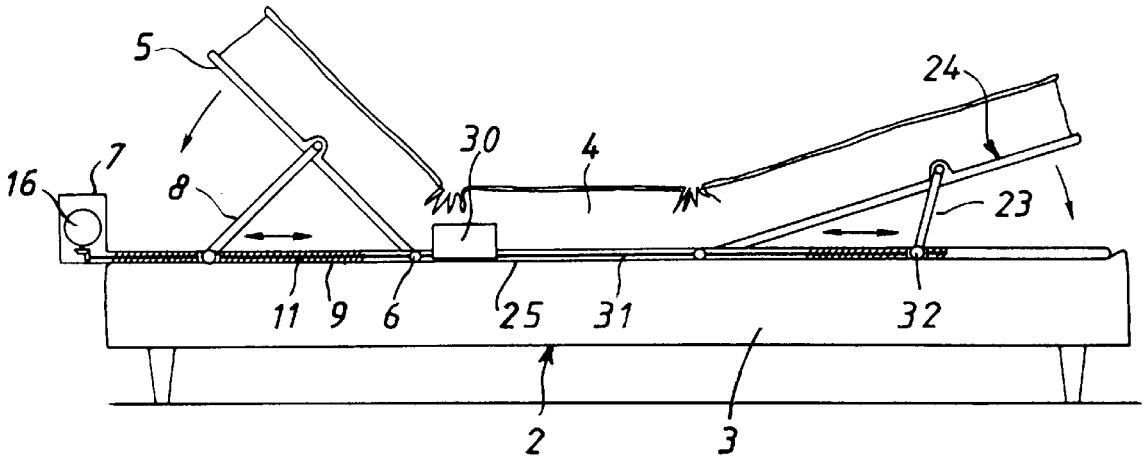
FIG. 3 is a diagrammatic elevation view showing a bed fitted with a device according to another variant of the invention.

In a third embodiment shown in FIG. 3, the bottom end and the top end of a bed can be tilted simultaneously.

The part of the device acting on the top end of the bed can be that in the first or second embodiment just described with the difference that the worm screws 11 are extended towards the bottom end of the bed by shafts 31 extending from housings 30 against which said worm screws 11 abut, as shown in FIG. 3.

These housings 30 equipped with disengagement mechanisms enable each of the worm screws 11 to be engaged and disengaged at will with the corresponding shafts 31, one threaded end of which also forms a worm screw.

A slide block 32 is engaged with this threaded part to control a lever 23 acting on a second movable frame 24 one side of which is pivotably mounted between slide members 25 extending the tubes 9 inside which are mounted the shafts 31. The second movable frame 24 hingedly connected to the fixed frame 9 supported on the bed base 3 supports the bottom of the mattress 4.

In this way the motor 16 can control the tilting of the bottom end of the bed as well as of the top end.

When the disengagement mechanism is actuated to disengage the shafts 31 from the worm screws 11, control of the tilting of the bottom end of the bed is deactivated. In other words, the tilt of the top end of the bed can be adjusted without affecting the tilt of the bottom end of the bed, the bottom end retaining the tilt that it had prior to disengagement.

Referring to FIGS. 4 to 7, the device 101 according to the invention consists of a fixed frame formed from two lateral tubes 109, here of rectangular section, supported by the bed base, and a movable frame 105 formed from a U-shaped frame pivotably mounted on and between the tubes 109 of the fixed frame by means of hinge pins 135.

Figure 7:
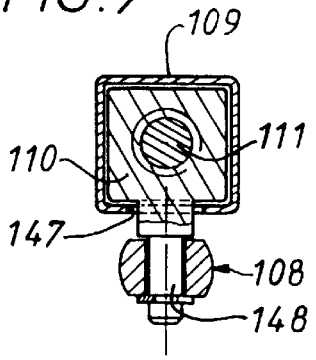
FIG. 7 is a cross-section view on the line VII—VII in FIG. 5.

Within each of the tubes 109 runs a movable slide block 110 the movement of which is controlled by the corresponding worm screw 111; as shown in FIG. 7, each slide block 110 has a spindle 148 which passes through a slot 147 in an outer wall of the tube 109, about which a lever 108 is hingedly connected; each of the levers 108 terminates at its other end in a curved part 134 at right angles to which it is hingedly connected to the frame 105, said curved part 134 being positioned in a sleeve 149 fastened to the frame 105, for example by welding.

As in the example described with reference to FIG. 2, each worm screw 111 carries at its end a pinion 112 which engages with a pinion 117 carried by a continuous shaft 118; the continuous shaft 118 also carries at one of its ends a pinion 119 which engages with the pinion 120 of the shaft 121 of a motor 122 positioned outside the device parallel to a lateral tube 109.

The ends of the worm screws 111 and the pinions 112 that they carry as well as the end parts of the continuous shaft 118 and the pinions 117 that they carry, are supported by casings 137 and 138 located at the ends of the lateral tubes 109 to which they are fastened; the ends of the worm screws 111, opposite to the ends that carry the pinions 112, are supported by centering bearings 151 mounted inside the lateral tubes

109 the quadrangular cross-section of which they fit; advantageously said casings 137 and 138 are linked by a cross-tube 136 which passes through the continuous shaft 118; the motor 122 and the pinions 119 and 120 are located in a housing 141 fastened to the adjacent lateral tube 109 and the casing 137 through the intermediary of a sole plate 150. The housing 141 and the casings 137, 138 protect the outside of the various pinions and the grease that they contain to enhance their lifespan.

According to a variant not shown, the dimensions of the parts such as the casings 137 and 138 are formed by extending the ends of the lateral tubes 109 in conjunction with end caps.

As shown, the device 101 just described includes a control unit 122-120-119-117-111-118 leaving the inside of the perimeter defined by the frames completely clear. In addition, a completely horizontal position can be achieved: the frame 105 fits inside the perimeter of the fixed frame defined by the lateral tubes 109 and the cross-tube 136, as partly shown in chain-dotted outline in FIG. 5, so that when the frames are completely horizontal they form a single plane such as the plane P in FIG. 6.

Figure 4:
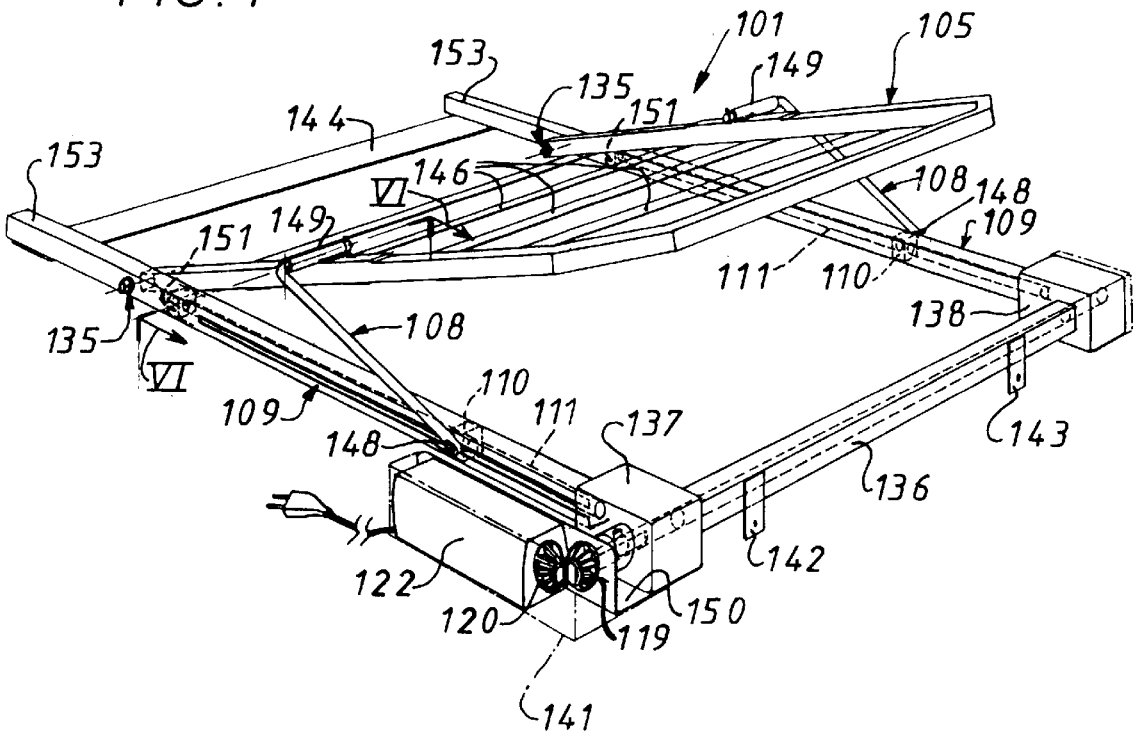
FIG. 4 is a diagrammatic perspective view showing another variant of a device according to the invention.

Without prejudicing the desired result, the frame 105 can carry elastic straps to support the mattress such as the straps 146 in FIG. 4.

According to the example described and shown, the control system is motorized: it will be understood that the same advantages are achieved with a manual control system; thus, for example, the pinions being rotatably interlocked with the shafts that carry them by flat end pieces such as the flat pieces 139, 140 of the shafts 118, 121 carrying the pinions 119, 120, all that is required is to eliminate the motor 122 and the pinions 119, 120 and to drive the pinions 117 through a crank cooperating with the flat pieces 139 of the cross-shaft 118.

Figure 8:
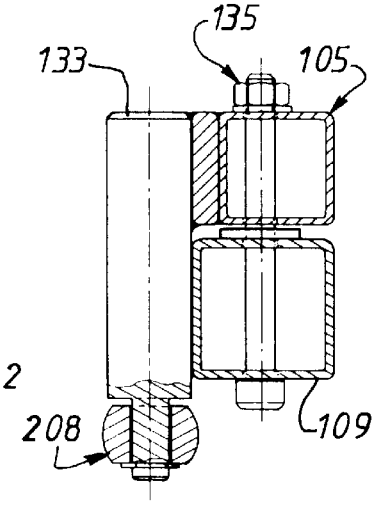
FIG. 8 is analogous to FIG. 6 but represents an alternative embodiment.
Figure 5:
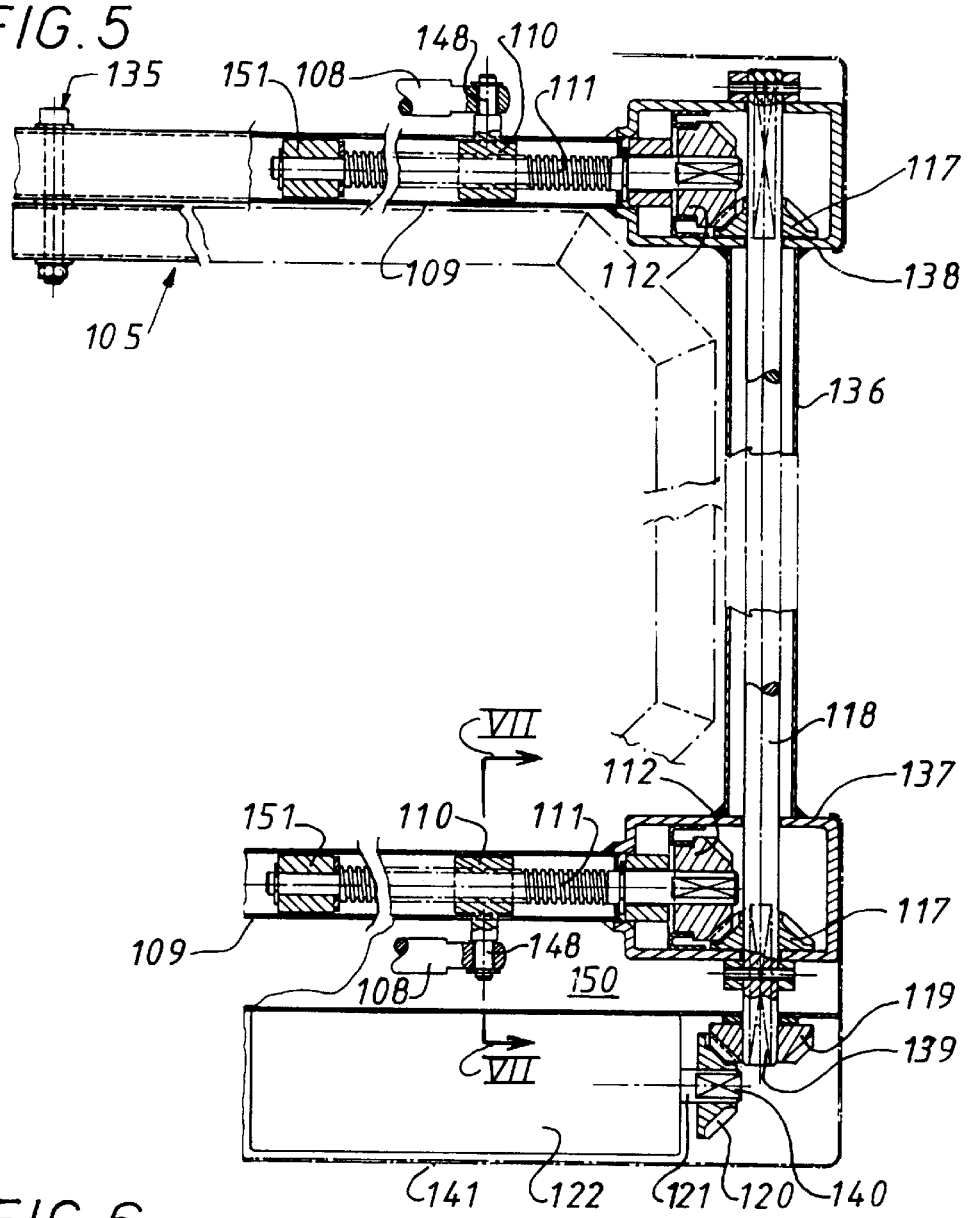
FIG. 5 is a partial top view partly cut away of the device in FIG. 4.
Figure 6:
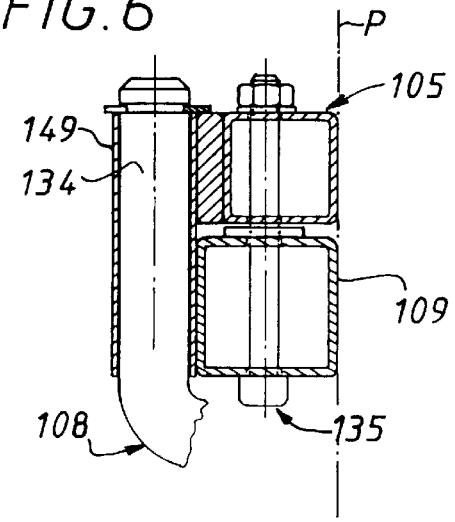
FIG. 6 is a cross-section view on the line VI—VI the device in FIG. 4.

FIG. 8 is analogous to FIG. 6 but shows an alternative lever hinge arrangement: here, the lever 208 is straight, with no curved part such as 134, and is hingedly connected directly to the end of the spindle support 133 attached to the frame 105.

Advantageously, fastening means can be provided to secure the device to the bed base. These are fastening means adapted to conventional bed bases not specially designed to accommodate the device. Such fastening means can, for example, include self-tapping screws, particularly in the case of wooden bed bases, cooperating with fastening lugs carried by the cross-tube 136, for example, such as the lugs 142, 143 in FIG. 4.

In this same FIG. 4, another means of securing a device is illustrated: this means consists of a flexible transverse band 144 linking the end extensions 153 of the lateral tubes 109; these end extensions 153 are long enough for the band 144 to receive part of the body of the person in bed who thus exerts pressure at right angles to the band 144 towards the bed base which secures the device.

Figure 9:
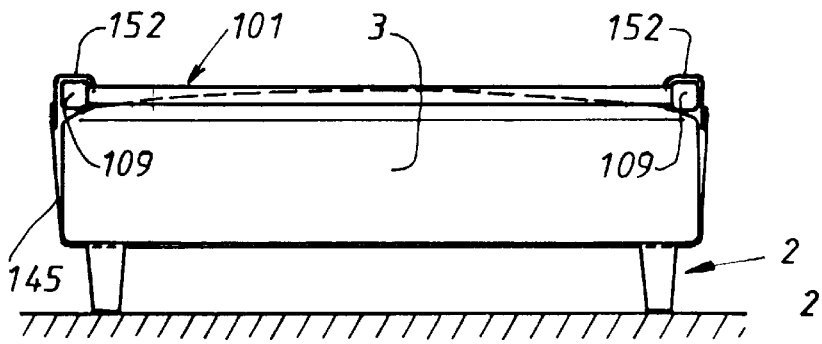
FIG. 9 is a diagram showing another way of securing the device to a bed.

According to FIG. 9, the device is secured by an elastic strap 145 passing under the bed base 3 and attached by its ends to the lateral tubes 109 by hooks 152.

However, whatever these fastening or securing means, they are designed so that the device is installed removably.

What is claimed is:

1. Device for tilting one of a top end and a bottom end of a bed, comprising two hingedly connected support frames and a control unit operably connected thereto for adjusting the spacing therebetween, said device being removably installable on a bed comprising a bed base and a mattress, wherein in use one, fixed frame is intended to lie on the bed base, while the other, movable frame is intended to support one end of the mattress, said frames being disposed in an adjustable V-shaped opening, and wherein the fixed frame comprises two parallel co-planar tubes, and the movable frame consists of a U-shaped frame pivotably mounted on and between said tubes, said movable frame fitting within an area delimited by the fixed frame, said control unit being attached to the fixed frame and controlling the longitudinal translation of slide blocks via worm screws, said blocks being slidable along said tubes to tilt the movable frame relative to the fixed frame, the worm screws associated with the slide blocks being mounted in said two tubes which extend longitudinally, and the control unit being located outside the area encompassed by the fixed frame, said device being constructed and arranged so that a completely horizontal position is obtainable, and the area of the fixed frame and the movable frame being free of mechanical element.

2. Device according to claim 1, wherein the fixed frame also consists of a U-shaped frame, said control unit being motorized and including a motor installed along the web of the U-shaped fixed frame, outside the area encompassed by the U-shaped fixed frame.

3. Device according to claim 2, wherein the motor is mounted in a housing which extends along the base of said U-shaped fixed frame outside the area encompassed by said U-shaped fixed frame.

4. Device according to claim 3, wherein the bottom side of the housing lies in the support plane of the U-shaped fixed frame.

5. Device according to claim 2, wherein the motor includes a shaft having two ends, each end having a pinion engaged with a pinion at the end of the worm screw mounted in each tube.

6. Device according to claim 1, wherein the fixed frame also consists of a U-shaped frame, said control unit being motorized and including a motor, said motor being installed along one side of said U-shaped fixed frame, outside the area encompassed by said U-shaped fixed frame.

7. Device according to claim 6, wherein the motor includes a shaft having an end which carries a pinion engaged with a pinion at the end of a second shaft which has two additional pinions, each engaged with a pinion at the end of the worm screw mounted in each tube.

8. Device according to claim 1, further comprising a second movable frame hingedly connected to the fixed frame for supporting the other end of the mattress, said control unit including an extension adapted to cooperate with slide blocks to adjust the angular position of the second movable frame.

9. Device according to claim 8, further comprising means for deactivating the control unit acting on said second movable frame.

10. Device according to claim 1, wherein each slide block includes a part which passes through the tube via a slot in said tube, each slide block being associated with a lever having a first end pivotably mounted on the slide block, and a second end pivotably mounted on one of the lateral sides of the associated movable frame.

11. Device according to claim 1, wherein the tubes of the fixed frame have ends which extend beyond the pivoting points of the movable frame, said ends being connected by a flexible transverse band for securing the device to the bed.

12. Device according to claim 1, further comprising fastening means for securing the device to the bed base.

13. Device according to claim 12; wherein the fixed frame also consists of a U-shaped frame, and the fastening means comprise self-tapping screws cooperating with lugs carried by the base of the U-shaped fixed frame.

* * * * *